US005301382A

United States Patent [19]

Stout

[11] Patent Number: 5,301,382

[45] Date of Patent: Apr. 12, 1994

[54] DRAIN CONDUIT ROUTER APPARATUS

[76] Inventor: Charles W. Stout, 18145-28 Soledad Canyon Rd., Canyon Country, Calif. 91351

[21] Appl. No.: 9,211

[22] Filed: Jan. 26, 1993

[51] Int. Cl.[5] ..... B08B 9/02

[52] U.S. Cl. ..... 15/104.33; 15/256.6

[58] Field of Search ..... 15/104.33, 256.6

[56] References Cited

U.S. PATENT DOCUMENTS 1,748,899 2/1930 Pilla ..... 15/256.6
3,531,059 9/1970 Walker ..... 15/104.33
4,340,988 7/1982 Shames et al. ..... 15/104.33
5,018,234 5/1991 Meyer et al. ..... 15/104.33

*Primary Examiner*—Edward L. Roberts
*Attorney, Agent, or Firm*—Leon Gilden

[57] ABSTRACT

A router structure is arranged to effect the routing of tubular fluid conduits and more particularly, tubular fluid conduits such as available in water coolers and the like, wherein the routing of mineral deposits is effected by the projection of a flexible wire coil sized to be received within such conduit and rotated relative to a housing containing the flexible wire coil for rejection through an associated housing tube.

2 Claims, 4 Drawing Sheets

FIG. 2
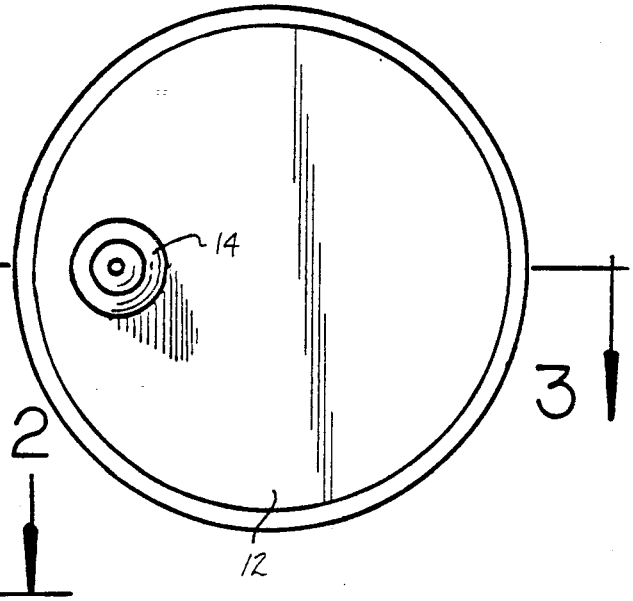
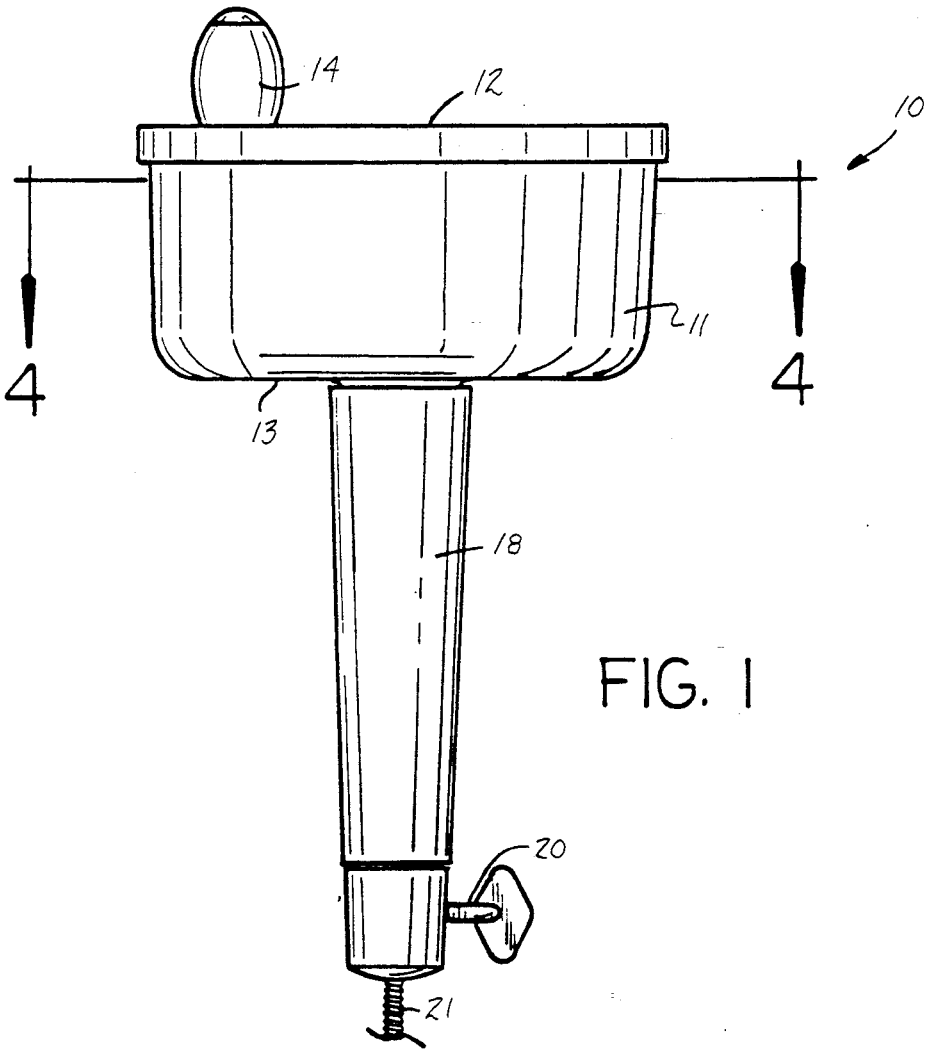
FIG. 1

FIG. 5
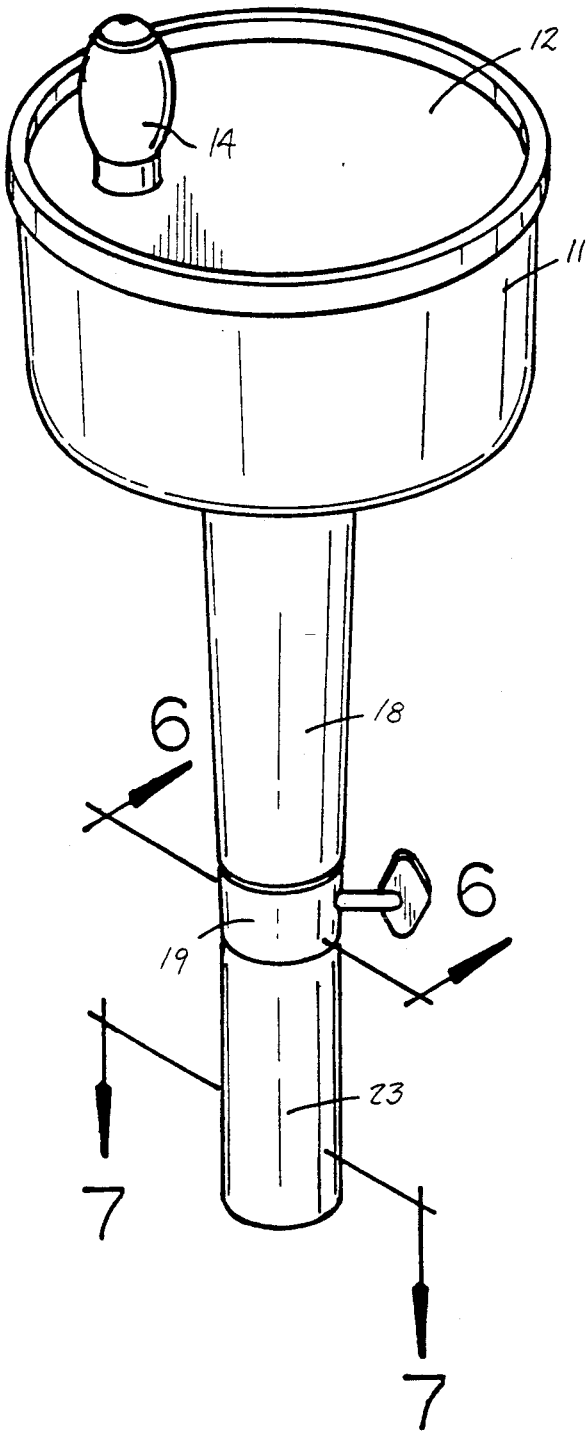
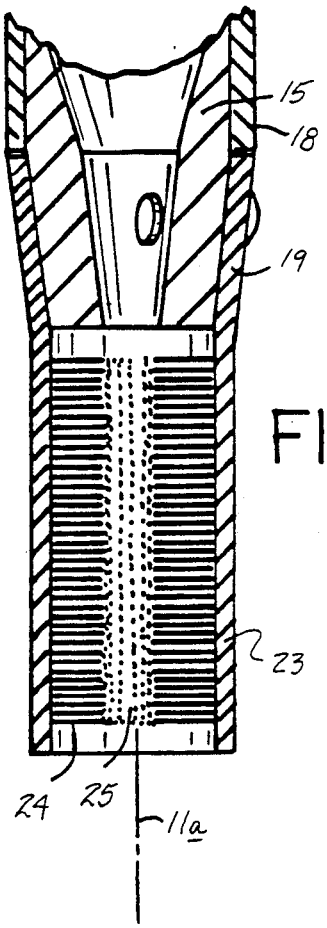
FIG. 6
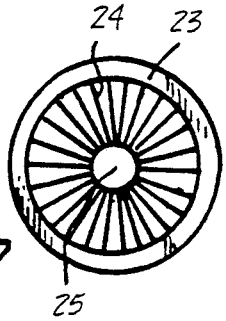
FIG. 7

DRAIN CONDUIT ROUTER APPARATUS

BACKGROUND OF THE INVENTION

1. Field of the Invention

The field of invention relates to drain conduit and snake routing structure, and more particularly pertains to a new and improved drain conduit router apparatus wherein the same is arranged for the cleaning and removal of mineral deposits within a drain conduit, particularly of a water cooler refrigeration structure.

2. Description of the Prior Art

Router apparatus of various types have been utilized throughout the prior art, such as exemplified in the U.S. Pat. Nos. 4,771,500; 4,604,603; 5,018,234; and 5,056,178.

The instant invention is directed to overcome the prior art by providing for a router structure arranged in a sized manner to effect the cleaning of conduits associated with swamp cooler structure and in this respect, the present invention substantially fulfills this need.

SUMMARY OF THE INVENTION

In view of the foregoing disadvantages inherent in the known types of router apparatus now present in the prior art, the present invention provides a drain conduit router apparatus wherein the same is directed to the cleaning of conduit structure relative to refrigeration tubes. As such, the general purpose of the present invention, which will be described subsequently in greater detail, is to provide a new and improved drain conduit router apparatus which has all the advantages of the prior art router apparatus and none of the disadvantages.

To attain this, the present invention provides a router structure arranged to effect the routing of tubular fluid conduits and more particularly, tubular fluid conduits such as available in water coolers and the like, wherein the routing of mineral deposits is effected by the projection of a flexible wire coil sized to be received within such conduit and rotated relative to a housing containing the flexible wire coil for rejection through an associated housing tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain conduit router apparatus which has all the advantages of the prior art router apparatus and none of the disadvantages.

It is another object of the present invention to provide a new and improved drain conduit router apparatus which may be easily and efficiently manufacture and marketed.

It is a further object of the present invention to provide a new and improved drain conduit router apparatus which is of a durable and reliable construction.

An even further object of the present invention is to provide a new and improved drain conduit router apparatus which is susceptible of a low cost of manufacture with regard to both materials and labor, and which accordingly is then susceptible of low prices of sale to the consuming public, thereby making such drain conduit router apparatus economically available to the buying public.

Still yet another object of the present invention is to provide a new and improved drain conduit router apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the invention.

FIG. 2 is an orthographic view, taken along the lines 2—2 of FIG. 1 in the direction indicated by the arrows.

FIG. 5 is an isometric illustration of a modified aspect of the invention.

FIG. 6 is an orthographic view, taken along the lines 6—6 of FIG. 5 in the direction indicated by the arrows.

FIG. 7 is an orthographic view, taken along the lines 7—7 of FIG. 5 in the direction indicated by the arrows.

DESCRIPTION OF THE PREFERRED EMBODIMENT

Figure 3:
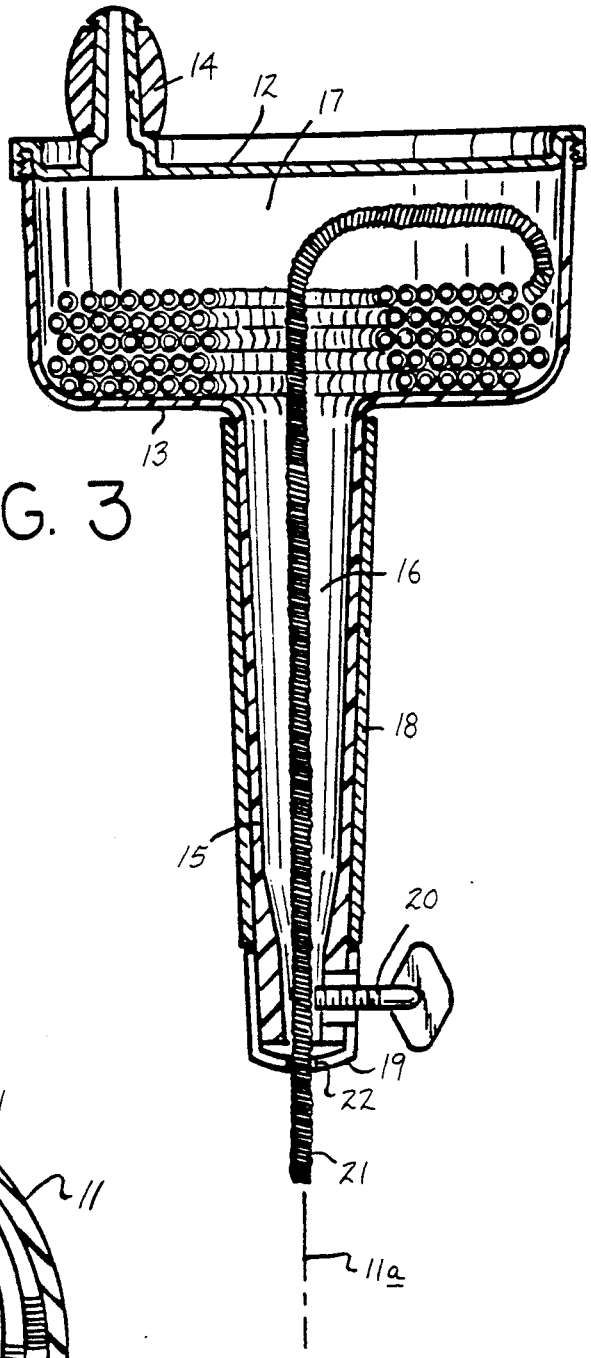
FIG. 3 is an orthographic view, taken along the lines 3—3 of FIG. 2 in the direction indicated by the arrows.
Figure 4:
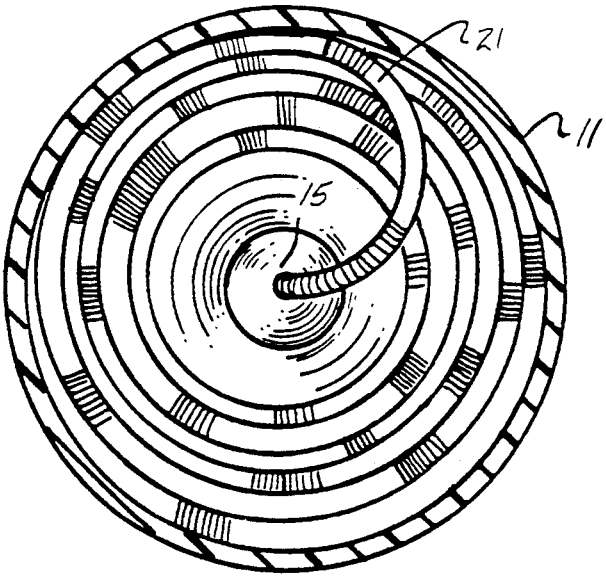
FIG. 4 is an orthographic top view, taken along the lines 4—4 of FIG. 1 in the direction indicated by the arrows.

With reference now to the drawings, and in particular to FIGS. 1 to 9 thereof, a new and improved drain conduit router apparatus embodying the principles and concepts of the present invention and generally designated by the reference numeral 10 will be described.

More specifically, the drain conduit router apparatus 10 of the instant invention essentially comprises a cylindrical primary housing 11, having a housing top wall 12 spaced from and parallel a housing bottom wall 13. A top wall handle 14 is rotatably and eccentrically mounted in an orthogonal relationship relative to the housing top wall 12 to effect rotation of the housing 11 upon rotation of the top wall 12 that is integrally secured to the housing 11. A housing tube 15 is medially and coaxially mounted relative to the housing bottom wall 13 oriented along in a symmetrical relationship relative to the housing axis 11*a* (see FIG. 1 for example). The bottom wall 13 is arranged to include a housing tube cavity 16 in communication with a primary housing cavity 17, with the primary housing 17 receiving and storing a coil of flexible wire coil 21 that is arranged for projection through the housing tube 15 from the primary housing 11. A housing tube end cap 19 is secured to the free distal end of the housing tube 15, to include an end cap fastener 20 directed through the end cap arranged for engaging the wire coil 21 within the primary housing cavity 17 in adjacency to the end cap opening 22 that is coaxially oriented relative to the axis 11*a*. The housing tube sleeve 18 rotatably and slidably mounted in surrounding relationship relative to the housing tube 15 between the housing bottom wall 13 and the end cap 19 permits manual grasping of the sleeve 18 to permit rotation of the wire coil 21 upon rotation of the housing 11 relative to the sleeve 18.

The FIGS. 5–7 indicate the further use of an extension tube 23 coaxially and fixedly mounted to the end cap 19 longitudinally aligned with the end cap 19, and more specifically the axis 11*a*. The cap extension tube 23 includes a cylindrical array of bristle brush members 24 directed substantially coextensive throughout the extension tube 23, having a brush bore 25 arranged to frictionally receive the wire coil 21 therethrough to effect cleaning of the wire coil when projected along and relative to the bristle brush array 24.

Figure 8:
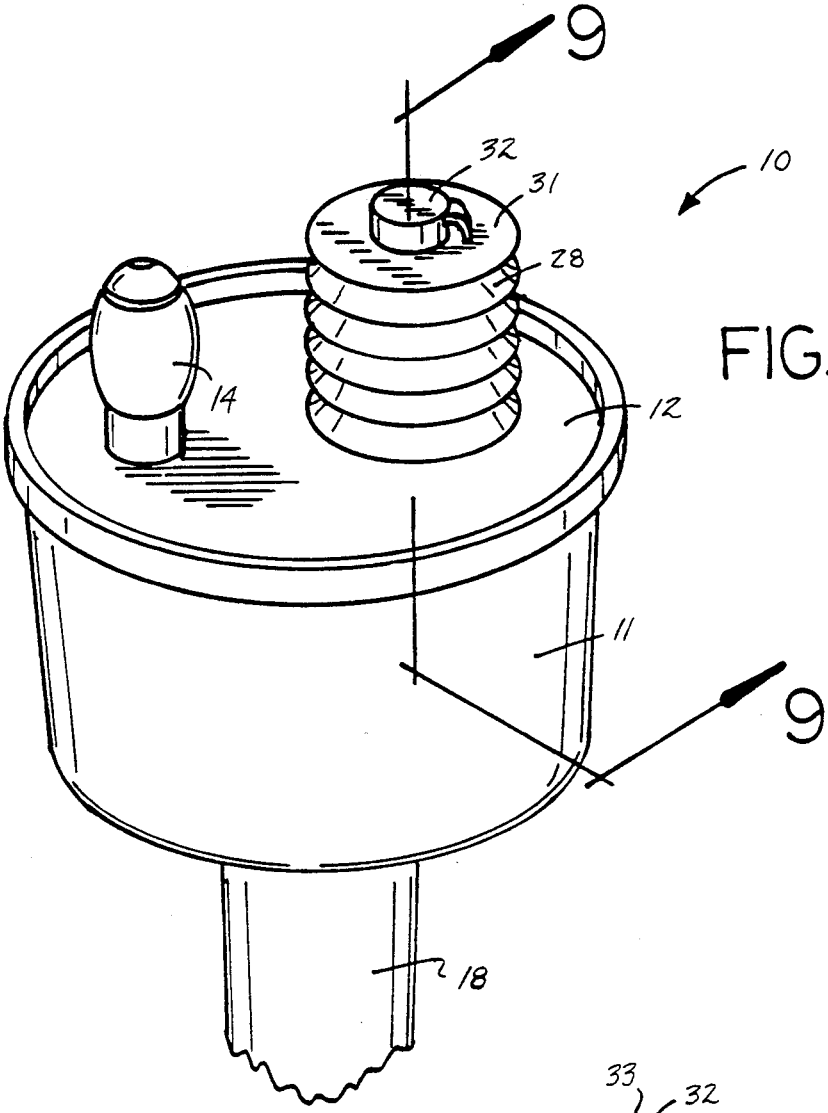
FIG. 8 is an isometric illustration of a modified top wall of the wire coil housing of the invention.
Figure 9:
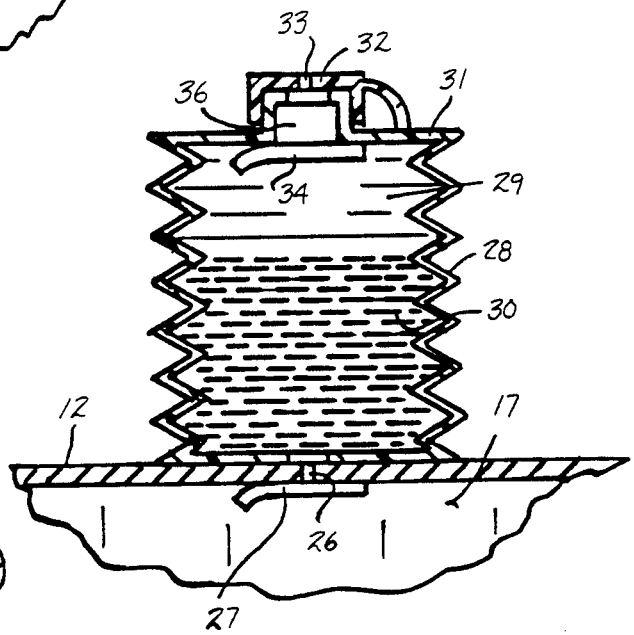
FIG. 9 is an orthographic view, taken along the lines 9—9 of FIG. 8 in the direction indicated by the arrows.

The FIGS. 8 and 9 indicate the further optional use of a bellows member 28 fixedly mounted to the housing top wall 12 coaxially aligned relative to a top wall bore 26. The top wall bore 26 is arranged in a spaced relationship relative to the axis 11*a*, with a resilient first valve plate 27 arranged to extend over the top wall bore 26 within the primary housing cavity 17. The first valve plate 27 is arranged for deflection relative to the top wall bore 26 upon pressurizing of a lubricating fluid such as oil 30 within the bellows fluid reservoir cavity 29 directed coextensively throughout the bellows. The bellows member 28 further includes a bellows top wall 31 having a bellows top wall cap 32 arranged for mounting over a bellows top wall fill port 36. The bellows top wall cap 32 includes a vent port 33 directed through the cap in communication with the fluid reservoir cavity 29 upon deflection of a bellows top wall resilient valve plate 34 arranged to extend over the bellows top wall fill port 36 in a first position and deflects relative to the bellows top wall fill port 36 when the bellows expands from a contracted position to compress the fluid reservoir cavity 29, deflect the first valve plate 27, and direct the lubricating fluid 30 into the primary housing cavity 17 for lubricating of the wire coil 21.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner to operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain conduit router apparatus, comprising, a cylindrical primary housing having a housing top wall spaced from and parallel a housing bottom wall, with a top wall handle orthogonally and rotatably mounted to the top wall, with the housing top wall and the housing bottom wall orthogonally and symmetrically oriented about a housing axis, and the top wall handle is arranged in a spaced relationship relative to the top wall axis, and a housing tube is fixedly mounted to the housing bottom wall coaxially aligned about the axis, with the housing tube having a housing tube cavity, the primary housing having a primary housing cavity, with the housing tube cavity and the primary housing cavity arranged in communication relative to one another, and the housing tube having a housing tube free distal end, with an end cap mounted to the free distal end in a fixed relationship, the end cap including an end cap fastener orthogonally oriented relative to the axis projecting into the housing tube cavity, and a flexible wire coil wound within the primary housing cavity and directed through the housing tube cavity, with the fastener arranged for engagement with the wire coil projecting through the cap within the housing tube cavity, the end cap having an end cap opening coaxially aligned with the axis to receive the wire coil therethrough in an extending relationship relative to the end cap and the housing tube cavity, and a housing tube sleeve rotatably mounted about the housing tube between the end cap and the housing bottom wall, and a cap extension tube fixedly mounted to the end cap coaxially aligned relative to the axis, with the cap extension tube including a cylindrical array of bristle brush members substantially coextensive throughout the extension tube, wherein the bristle brush members includes a brush bore coaxially aligned relative to the axis to engage the wire coil directed therethrough to effect cleaning of the wire coil when projected relative to the bristle brush array.

2. An apparatus as set forth in claim 1 wherein the top wall includes a top wall bore arranged in a spaced relationship relative to the axis, and a resilient first valve plate mounted to the housing top wall within the primary housing cavity and arranged to deflect relative to the housing top wall within the primary housing cavity upon projection of pressurized fluid through the top wall bore, and a bellows member fixedly mounted to the housing top wall extending in surrounding relationship relative to the top wall bore, with the bellows member including a fluid reservoir cavity therewithin, having a lubricating fluid therewithin, the bellows including a bellows top wall, the bellows top wall including a bellows top wall fill port and a top wall cap mounted to the fill port, wherein the cap includes a cap vent bore, and a second resilient valve plate is mounted to the bellows top wall within the fluid reservoir cavity deflecting relative to the bellows top wall within the reservoir cavity subsequent to projection of the bellows top wall towards the housing top wall in a first position permitting expansion of the bellows top wall relative to the housing top wall in a second position.

* * * * *